US005362556A

United States Patent [19]

Shini

[11] Patent Number: 5,362,556

[45] Date of Patent: Nov. 8, 1994

[54] PRESSURE-SENSITIVE TRANSFER RECORDING MEDIUM

[75] Inventor: Masami Shini, Osaka, Japan

[73] Assignee: Fujicopian Co., Ltd., Osaka, Japan

[21] Appl. No.: 100,415

[22] Filed: Aug. 2, 1993

[30] Foreign Application Priority Data

Aug. 3, 1992 [JP] Japan ..... 4-206673

[51] Int. Cl.[5] ..... B41M 5/03

[52] U.S. Cl. ..... 428/321.3; 428/195; 428/206; 428/207; 428/326; 428/914

[58] Field of Search ..... 428/207, 321.3, 488.1, 428/914, 195, 206, 326

[56] References Cited

U.S. PATENT DOCUMENTS 3,904,802 9/1975 Brown et al. ..... 428/321.3

4,713,281 12/1987 Shini ..... 428/321.3

*Primary Examiner*—Pamela R. Schwartz

*Attorney, Agent, or Firm*—Adduci, Mastriani, Schaumberg & Schill

[57] ABSTRACT

A pressure-sensitive transfer recording medium adapted to overlapping strike printing on a low-noise impact printer, comprising a foundation, and a porous ink-releasing layer containing an ink paste provided on the foundation, the ink paste comprising a coloring agent, a liquid vehicle and a starch substance, the liquid vehicle comprising as a main component at least one member selected from the group consisting of a glycerol higher fatty acid ester, a polyglycerol higher fatty acid ester and a sorbitan higher fatty acid ester, the ink paste having a viscosity of $4\times10^3$ to $12\times10^3$ cp at 25° C. The recording medium ensures images of a high density for an initial strike and an excellent printing durability, thereby giving clear images without blot or unevenness for a multiplicity of overlapping strikes at the same portion of the recording medium, in printing on a low-noise impact printer under low-temperature circumstances as well as under ordinary-temperature circumstances.

6 Claims, No Drawings

PRESSURE-SENSITIVE TRANSFER RECORDING MEDIUM

BACKGROUND OF THE INVENTION

The present invention relates to a pressure-sensitive transfer recording medium, and more particularly, to a pressure-sensitive transfer recording medium adapted to overlapping strike printing such as over-strike or multi-strike printing on a low-noise impact type typewriter or printer.

For many years, office rooms have been places where business machines generating uncomfortable noises, such as typewriters or high-speed impact printers, are placed. When a number of such machines are placed together in one room, cumulative noises tend to do harm to the health or mental conditions of the workers serving in the room.

Under the circumstances, some attempts have been made to reduce such noises, including one wherein an impact printer is contained within a muffling covering and another wherein a low-noise printer is designed on the basis of non-impact printing techniques such as ink-jet printing and thermal transfer printing.

On the other hand, official standards on the maximum allowable noise level in offices have been provided.

Generally, an impact printer generates an average noise of 70 to 80 dB or more. The noise is of an impacting characteristic and generated mainly when a hammer is driven to impact against a pad of typefaces so that the pad is forced to be pressed against an ink ribbon superposed on a printing paper placed on a platen by a force sufficient to transfer the ink to the printing paper from the ink ribbon.

Recently, there have been put on the market new types of serial impact printers wherein noise generated due to impact during a printing operation is sharply reduced (refer to JP,A,62-7572, JP,A,62-7573, JP,A,62-7574, JP,A,62-9969 and JP,A,62-132649).

Ink ribbons usable in serial impact printers include a correctable ink ribbon and a multi-strike ink ribbon. In the case of the former, conventional ones gives images of a high quality but in the case of the latter, conventional ones are of no practical use.

Conventional multi-strike ink ribbons include one which has on a foundation a porous layer composed of porous particles and a resinous binder material for bonding the porous particles to each other, and containing a liquid ink paste which contains a mineral oil and an aliphatic amine salt as a wetting agent, each being incompatible with the resinous binder material, as the main components of the vehicle thereof, and has a viscosity of 4,000 to 10,000 cp at ordinary temperature, as shown in JP,A,58-29694. JP,A,63-309567 discloses the use as the above-mentioned liquid ink paste of one wherein the main component of the vehicle is a dimer acid and the viscosity of the paste is adjusted to a range of 5,000 to 25,000 cp at ordinary temperature. JP,A,61-24486 discloses to the use as the above-mentioned liquid ink paste of one wherein the main component of the vehicle is a liquid fatty acid and the viscosity of the paste is adjusted to a range of less than 4,000 cp at ordinary temperature.

However, such conventional multi-strike ink ribbons are of no practical use on the low-noise impact printer, because the optical density of images sharply decreases for repeated overlapping strikes. This tendency is remarkable with the ink ribbon disclosed in JP,A,61-24486 using an ink paste of a low viscosity and the ink ribbon cannot be used practically.

Recently there is a demand for a multi-strike ribbon which can be used satisfactorily under circumstances at low temperatures of not more than 10° C.

It is an object of the present invention to provide a pressure-sensitive transfer recording medium which can give clear images for a multiplicity of overlapping strikes on a low-noise impact printer under low-temperature circumstances as well as under normal circumstances.

SUMMARY OF THE INVENTION

The present invention provides a pressure-sensitive transfer recording medium adapted to overlapping strike printing on a low-noise impact printer, comprising a foundation, and a porous ink-releasing layer containing an ink paste provided on the foundation, the ink paste comprising a coloring agent, a liquid vehicle and a starch substance, the liquid vehicle comprising as a main component at least one member selected from the group consisting of a glycerol higher fatty acid ester, a polyglycerol higher fatty acid ester and a sorbitan higher fatty acid ester, the ink paste having a viscosity of $4\times10^3$ to $12\times10^3$ cp at 25° C.

The recording medium of the present invention ensures images of a high density for an initial strike and an excellent printing durability, thereby giving clear images without blot or unevenness for a multiplicity of overlapping strikes at the same portion of the recording medium, in printing on a low-noise impact printer under low-temperature circumstances as well as under ordinary-temperature circumstances.

DETAILED DESCRIPTION

The feature of the pressure-sensitive transfer recording medium adapted to overlapping strike printing in accordance with the present invention is that a starch substance is incorporated in the ink paste thereof, the above-mentioned specific substance is used as a main component of the liquid vehicle thereof and the viscosity of the ink paste is adjusted to a range of $4\times10^3$ to $12\times10^3$ cp at 25° C.

This feature enables favorable overlapping strike printing wherein an initial strike gives images having a markedly high density, the degree of decrease in image density is small for subsequest overlapping strikes, and the subsequent overlapping strikes give images of a high quality without blot or unevenness.

The reasons therefor are mentioned below. In the case of a low-noise impact printer including a mechanism wherein a printing force is transmitted and character elements are driven to be pressed against a platen by means of a print chip, the effective mass, contact duration and speed of a hammer at the location where the character element is, for the first time, brought into contact with the platen, are altered as shown in Table 1, as compared with those of the conventional impact printer, for the purpose of reducing noise.

TABLE 1

| | Low-noise impact printer | Conventional impact printer |
|---|---|---|
| Effective mass of hammer at contact | 1,350 g | 900 to 1,800 g |
| Contact duration | 4 to 6 ms | 50 to 100 μs |

TABLE 1-continued

| | Low-noise impact printer | Conventional impact printer |
|---|---|---|
| Speed at contact | 5 to 8 cm/sec | 203 to 254 cm/sec |

As is clear from Table 1, the low-noise impact printer is designed such that the pressing pressure against the recording medium is kept for a longer time than that with the conventional impact printer. When the conventional recording medium is used on such a low-noise impact printer, the ink paste contained in the porous ink-releasing layer is exuded non-uniformly and the optical density of images decreases sharply for repeated overlapping strikes. This tendency is remarkable with an ink paste having a lower viscosity at ordinary temperature.

In order to overcome the problem, it may be considered that the viscosity of the ink paste at ordinary temperature is increased. In that case, however, the viscosity of the ink paste at low temperatures becomes extremely high, which causes a problem that the amount of the ink paste exuded from the porous ink-releasing layer decreases, resulting in a decrease in optical density of images.

The present inventor has made intensive researches to find out a means for uniformly exuding the ink paste from the porous ink-releasing layer in printing at ordinary temperature without increasing the viscosity of the ink paste at ordinary temperature and has found that the desired object can be accomplished by incorporating a starch substance in the ink paste and using the above-mentioned specific oil-soluble surface active agent as the liquid vehicle of the ink paste.

The starch substance used in the present invention retains substantially the original particle form although it is swollen in the ink paste. The starch substance is presumed to have a function of carrying an ink paste and a function of adequately suppressing the exudation of the ink paste from the porous ink-releasing layer.

By the combination of the functions of the starch substance and the function of the specific oil-soluble surface active agent as the liquid vehicle, the ink paste is exuded in portions of a proper amount from the porous ink-releasing layer for overlapping strikes at ordinary temperature without increasing the viscosity of the ink paste. Even in printing at lower temperature, the exudation of the ink paste is not hindered because the viscosity of the ink paste is not extremely high.

As described above, by the use of the recording medium of the present invention, the exudation of the ink paste from the porous ink-releasing layer is made uniform and a predetermined amount of the ink paste is exuded by each strike in printing either under ordinary temperature circumstances or under low-temperature circumstances, resulting in favorable overlapping strike printing wherein the images produced by an initial strike have a high optical density, the degree of decrease in optical density of images is small for subsequent repeated overlapping strikes, and the subsequent strikes give images of a high quality without blot or unevenness.

By the present invention, there has been, for the first time, put to practical use a pressure-sensitive recording medium capable of overlapping strike which makes it possible to reduce impact noises during a printing operation, and which has a long life to give images of a high quality in printing under low-temperature circumstances as well as ordinary-temperature circumstances.

The present invention will be explained in more detail.

The ink paste used in the present invention contains a starch substance and at least one oil-soluble liquid surface active agent selected from the group consisting of a glycerol higher fatty acid ester, a polyglycerol higher fatty acid ester and a sorbitan higher fatty acid ester as a main component of the vehicle thereof, and has a viscosity of $4\times10^3$ to $12\times10^3$ cp at 25° C. (hereinafter, the viscosity value means one measured at 25° C., unless otherwise noted).

The starch substance preferably used in the present invention is one wherein its particles are relatively so hard that the particles are not finely divided in the kneading step for the preparation of the ink paste and have a desired particle size in the ink paste.

Examples of such a starch substance include starches such as corn starch and starch derivatives such as esterified starches and etherified starches. Examples of the esterified starches include lower acyl-substituded starches such as acetyl starch. Examples of the etherified starches include lower alkyl-substituted or lower hydroxyalkyl-substituted starches such as methyl starch, ethyl starch, hydroxyethyl starch and hydroxypropyl starch. The etherified starches are particularly preferred. Examples of commercial products of etherified starches are Unique Gum P-3010, Unique Gum H-M and Corn Starch White (all made by Matsutani Kagaku Kabushiki Kaisha).

The starch substance used in the present invention maintains substantially its original particle form in the ink paste although it is swollen. From this viewpoint, starch substances having an average particle size of 5 to 30 μm are preferably used. When the average particle size is less than 5 μm, the property of holding the ink paste and the property of suppressing the exudation of the ink paste are poor. When the average particle size is more than 30 μm, the exuding property of the ink paste is poor and the surface of the ink-releasing layer becomes uneven and the ink-releasing layer becomes thicker.

The content of the starch substance in the ink paste is preferably from 3 to 10% (% by weight, hereinafter the % means % by weight). When the content of the starch substance is less than 3%, the effect exhibited by addition of the starch substance is insufficient. When the content of the starch substance is more than 10%, the exudation of the ink paste is hindered.

When the viscosity of the ink paste is less than $4\times10^3$ cp, the degree of decrease in optical density of images for repeated overlapping strikes is large and the blot or blur of images is caused. When the viscosity of the ink paste is more than $12\times10^3$ cp, the optical density of images obtained at low temperatures is decreased and unevenness of images such as scratchiness is caused.

Examples of the glycerol higher fatty acid esters are glycerol monoisostearate, and the like. Examples of the polyglycerol higher fatty acid esters are diglycerol monoisostearate, decaglycerol pentaisostearate, tetraglycerol monooleate, and the like. Examples of the sorbitan higher fatty acid esters are sorbitan monoisostearate, sorbitan monooleate, sorbiban trioleate, sorbitan sesquioleate, and the like.

The content of the oil-soluble surface active agent in the ink paste is preferably from 20 to 60%. When the content of the oil-soluble surface active agent is less than 20%, the optical density of images with initial strike becomes lower. Further, it is difficult to adjust the viscosity of the ink paste to a desired value, and it is difficult to disperse pigments uniformly, resulting in a poor stability of the ink paste. When the content of the oil-soluble surface active agent is more than 60%, the heat stability of the ink paste becomes poor and images become blotted, resulting in a poor clearness of images. Further, the surface of the ink-releasing layer becomes tacky, so that the recording medium wound in a roll form is apt to cause blocking because the front surface and back surface of the recording medium adhere to each other.

Various pigments or dyes can be used as the coloring agent of the ink paste. Usually a pigment alone or a combination of a pigment and a dye is used. A combination of a pigment and an oil-soluble dye is preferable. The coloring agent is preferably used in an amount of 21 to 55% on the basis of the total amount of the ink paste.

Examples of the pigment include carbon blacks such as Printex 25 (commercial name of a coloring carbon black made by DEGUSSA), Mogul L ( commercial name of a coloring carbon black made by Cabot Corp.) and Raven 1255, 3500 (commercial name of a coloring carbon black made by Columbia Ribbon & Carbon Manufacturing Corp. ); and black toner. These pigments may be used singly or as admixtures of two or more kinds thereof. The pigment is used preferably in an mount of 20 to 40% on the basis of the total amount of the ink paste.

Examples of the oil-soluble dye include, for instance, Nigrosine Base, Spirit Black, Special Black, Victoria Blue Base and Methyl Violet Base. These oil-soluble dyes may be used singly or as admixtures of two or more kinds thereof. The oil-soluble dye is used preferably in an amount 1 to 15% on the basis of the total amount of the ink paste.

The ink paste in the present invention may be incorporated with various additives such as a viscosity-adjusting agent and a dye-dissolving agent in addition to the above components.

Examples of the viscosity-adjusting agent include vegetable oils such as rapeseed oil, soybean oil and castor oil; mineral oils such as vitrea oil and jet oil; coldproof plasticizers such as di(2-ethylhexyl) adipate, di(2-ethylhexyl) sebacate and di(2-ethylhexyl) azelate (hereinafter referred to as "DOZ"); hydrocarbon oils such as lipolube oil; and liquid oligomers of ethylene and α-olefin (such as Lucant HC-100, HC-150 made by Mitsui Petrochemical Industries, Ltd.). These viscosity-adjusting agents may be used singly or as admixtures of two or more kinds thereof. Usually, the viscosity-adjusting agent is used in an amount of 0 to 30%, preferably 5 to 30%, on the basis of the total amount of the ink paste.

When a dye is used as a component of the coloring agent, it is preferable to use a dye-dissolving agent.

As the dye-dissolving agent, there can be used oleic acid, isostearic acid and liquid fatty acids analogous thereto. These liquid fatty acids may be used singly or as admixtures of two or more kinds thereof. Usually, the dye-dissolving agent is used in an amount of 0 to 30%, preferably 5 to 30%, on the basis of the total amount of the ink paste, although the amount of the dye-dissolving agent varies depending upon the amount of the dye used.

Various conventional porous layers can be used as the porous layer in which the ink paste is to be contained. However, from the viewpoint of a small degree of decrease in optical density of images with repeated overlapping strikes, and the like, there is preferably used a microporous layer composed of porous particles and a resinous binder material for bonding the porous particles to each other. With this porous layer, the ink paste is contained in the pores of each particle as well as in the pores formed among the particles bonded with the resinous binder material.

The ink-releasing layer having the construction wherein an ink paste is contained in the above-mentioned porous layer may be formed by previously forming a porous layer on a foundation and then allowing the porous layer to contain an ink paste. However, the following method is preferable wherein the ink-releasing layer can be formed by single step utilizing phase separation.

That is, a resinous binder material incompatible or immiscible with an ink paste is dissolved in a volatile solvent. In the solution is dispersed or dissolved an ink paste and porous powder particles. The resultant mixture is applied to a foundation and dried to give an ink-releasing layer wherein the ink paste is contained in a porous layer composed of the porous particles and the resinous binder material.

The resinous binder material mentioned above is one or more resins which are incompatible or inmiscible with the above-mentioned ink paste and show a good adhesion to the porous particles mentioned below. Examples of the resinous binder material are, for instance, vinyl chloride-vinyl acetate copolymer, polyester resin, cellulose acetate butyrate, and the like. The amount of the binder material is preferably from 1 to 10 parts (parts by weight, hereinafter parts means parts by weight), more preferably from 2 to 6 parts, per 10 parts of the ink paste.

The above-mentioned porous particles are preferably those which have an average porosity of 50 to 97%, more preferably 60 to 93% and an average particle size of 1 to 20 μm, including inorganic porous powders such as diatomaceous earth, zeolite, porous silica powder and activated carbon, and organic porous powders such as foamed polyurethane powder. Those porous powders may be used singly or as admixtures of two or more kinds thereof. The porous powder is used, preferably in an amount of 1 to 6 parts, more preferably 2 to 5 parts, per 10 parts of the ink paste.

As the volatile solvent, there can be used one or more solvents capable of dissolving the resinous binder material without particular limitation. Examples of the volatile solvent include methyl ethyl ketone, acetone, methyl isobutyl ketone, toluene, and IP Solvent (commercial name of an isoparaffin hydrocarbon oil made by IDEMITSU KOSAN CO., LTD.).

The ink-releasing layer in the present invention may be a layer wherein the ink paste is contained in a porous layer composed of a resin alone without using the porous particles. This ink-releasing layer can be formed by the same phase separation method as mentioned above, using the same kind of resin as the resinous binder material, except that the porous particles are not used.

The thickness of the ink-releasing layer is preferably from 15 to 30 g/m$^2$ in terms of coating amount after being dried.

As the foundation, there can be preferably used films having a thickness of 3 to 50 μm, including polyester films, polypropylene films and polyamide films.

The recording medium of the present invention is preferably used in low-noise type impact typewriters or printers, for example, wire-dot printers and daisy wheel printers, thereby realizing a reduction of noise.

The present invention will now be more particularly described with reference to the following Examples. These Examples are intended to illustrate the invention and not to be construed to limit the scope of the invention. It is to be understood that various changes and modifications may be made in the invention without departing from the spirit and scope thereof.

Examples 1 to 4 and Comparative Example 1 to 2

The components for each ink paste as shown in Table 2 were mixed and kneaded thoroughly to prepare an ink paste.

Into a mixed solvent of 5 parts of toluene and 52 parts of methyl ethyl ketone were dissolved 12.5 parts of Solution Vinyl VYHH (vinyl chloride-vinyl acetate copolymer having a vinyl chloride content of 83% made by Union Carbide Corp). To the solution were added 22 parts of the ink paste and 8.5 parts of Celite Super Floss (Zeolite made by Johns Manville International Corp, average particle size: 5 μm, average porosity: 85%), followed by thorough mixing.

The thus obtained mixture were applied onto a polyester film having a thickness of 7 μm and dried to form an ink-releasing layer having a coating amount of 20 g/m$^2$ after being dried.

Each of the obtained recording media was installed in a low-noise type impact typewriter (Piano made by Xerox Corp.). Printing was carried out to produce images on a recording paper (typewriting paper LIFE T-21 ) in such a manner that the same portion of the recording medium was struck repeatedly by the same typeface, while the strike position against the recording paper was changed with each strike.

The density (PCS value) of the images obtained on the recording paper was measured by means of a densitometer (Macbeth PCM II). The density of the image obtained by the first strike (A), that by the fifth strike (B) and the lowering rate defined according to the following formula are shown in Table 3.

$$\text{Lowering rate (\%)} = \frac{\text{Density } (A) - \text{Density } (B)}{\text{Density } (A)} \times 100$$

TABLE 2

| Component | | Ex. 1 | Ex. 2 | Ex. 3 | Ex. 4 | Com. Ex. 1 | Com. Ex. 2 |
|---|---|---|---|---|---|---|---|
| Pigment | RAVEN 1255 | 23.5 | | | 21.2 | | |
| | RAVEN 3500 | | 20.5 | 20.5 | | 23.0 | 25.0 |
| Dye | Nigrosine Base EX | 4.0 | 4.5 | 4.0 | 5.0 | 5.0 | 10.0 |
| Oil-soluble surface active agent | Diglycerol monoisostearate | 30.0 | 34.3 | | | 28.0 | |
| | Sorbitan monooleate | | | 30.5 | 27.7 | | 20.0 |
| Dye-dissolving agent | Isostearic acid | 13.0 | 15.4 | 14.0 | 16.0 | 15.0 | 20.0 |
| Viscosity-adjusting agent | DOZ | 20.0 | | 20.0 | 19.8 | 24.0 | |
| | Lucant HC-100 | | 10.1 | | | | 25.0 |
| Other surface active agent | Lecithin | 6.0 | 5.7 | 5.0 | 4.6 | 5.0 | |
| Starch | Unique Gum H-M (average size: 10 μm) | 3.5 | | 6.0 | | | |
| | Corn Starch White (average size. 20 μm) | | 9.5 | | 5.7 | | |
| Ink paste viscosity (cp at 25° C.) | | 8,678 | 11,340 | 5,010 | 6,494 | 8,256 | 24,000 |

Note The values in Table 2 mean percentages by weight of respective components on the basis of the total amount of ink paste.

TABLE 3

| Temp. in printing | Values found | Ex. 1 | Ex. 2 | Ex. 3 | Ex. 4 | Com. Ex. 1 | Com. Ex. 2 |
|---|---|---|---|---|---|---|---|
| 25° C. | Density (PCS) | | | | | | |
| | 1st strike | 0.86 | 0.85 | 0.87 | 0.85 | 0.87 | 0.85 |
| | 5th strike | 0.70 | 0.71 | 0.70 | 0.70 | 0.67 | 0.70 |
| | Lowering rate (%) | 18.6 | 16.5 | 19.5 | 17.6 | 23.0 | 17.6 |
| 10° C. | Density (PCS) | | | | | | |
| | 1st strike | 0.78 | 0.75 | 0.77 | 0.79 | 0.79 | 0.55 |
| | 5th strike | 0.65 | 0.68 | 0.62 | 0.64 | 0.64 | 0.50 |
| | Lowering rate (%) | 16.7 | 9.3 | 19.5 | 19.0 | 19.0 | 9.1 |

The results of Table 3 reveal the following:

In the case of Examples 1 to 4 each using an ink paste which contains a starch substance and the specific oil-soluble liquid surface active agent as the vehicle thereof and has a viscosity of $4\times10^3$ to $12\times10^3$ cp, the image density with the initial strike is high and the lowering rate of the image density is small with printing at a low temperature as well as with printing at an ordinary temperature.

In contrast thereto, in the case of Comparative Example 1 using an ink paste which does not contain the starch substance although the viscosity of the ink paste falls within the range defined in the present invention, the lowering rate of the image density is remarkably large with printing at an ordinary temperature. In the case of Comparative Example 2 using an ink paste which does not contain the starch substance and has a viscosity of more than $12\times10^3$ cp, the image density with the initial strike is low with printing at a low temperature.

In addition to the ingredients or materials used in the Examples, other ingredients or materials can be used in the Examples as set forth in the specification to obtain substantially the same results.

What is claimed is:

1. A pressure-sensitive transfer recording medium adapted to overlapping strike printing on a low-noise impact printer, comprising a foundation, and a porous ink-releasing layer containing an ink paste on the foundation, the ink paste comprising a coloring agent, a liquid vehicle and a starch, the liquid vehicle comprising at least one member selected from the group consisting of a glycerol higher fatty acid ester, a polyglycerol higher fatty acid ester and a sorbitan higher fatty acid ester, the ink paste having a viscosity of $4\times10^3$ to $12\times10^3$ cp at 25° C.

2. The pressure-sensitive transfer recording medium of claim 1, wherein the content of the starch in the ink paste is from 3 to 10% by weight.

3. The pressure-sensitive transfer recording medium of claim 1, wherein the starch is at least one member selected from the group consisting of corn starch, an etherified starch and an esterified starch.

4. The pressure-sensitive transfer recording medium of claim 1, wherein the starch has an average particle size of 5 to 30 μm before swelling.

5. The pressure-sensitive transfer recording medium of claim 1, wherein the ink paste contains 21 to 55% by weight of the coloring agent, 20 to 60% by weight of the liquid vehicle and 3 to 10% by weight of the starch.

6. The pressure-sensitive transfer recording medium of claim 1, wherein the porous ink-releasing layer comprises a porous layer comprising minute porous particles and a resinous binder material for bonding porous particles to each other, and the ink paste contained in the porous layer.

* * * * *